US005645894A

United States Patent [19]

Trankiem

[11] Patent Number: 5,645,894

[45] Date of Patent: Jul. 8, 1997

[54] METHOD OF TREATING RAZOR BLADE CUTTING EDGES

[75] Inventor: Hoang Mai Trankiem, Watertown, Mass.

[73] Assignee: The Gillette Company, Boston, Mass.

[21] Appl. No.: 587,410

[22] Filed: Jan. 17, 1996

[51] Int. Cl.[6] ..... B05D 1/02; B05D 3/02; B05D 5/08

[52] U.S. Cl. ..... 427/421; 427/195; 427/284; 427/375; 427/422

[58] Field of Search ..... 427/421, 422, 427/195, 284, 375, 388.1

[56] References Cited

U.S. PATENT DOCUMENTS

| | | | |
|---|---|---|---|
| 4,582,731 | 4/1986 | Smith | 427/421 |
| 5,263,256 | 11/1993 | Trankiem | 30/346.54 |
| 5,290,602 | 3/1994 | Argyropaoulos et al. | 427/422 |
| 5,290,603 | 3/1994 | Nielsen et al. | 427/422 |
| 5,478,905 | 12/1995 | Anolick et al. | 526/254 |

*Primary Examiner*—Diana Dudash
*Attorney, Agent, or Firm*—Chester Cekala

[57] ABSTRACT

The present invention relates to a method of forming a polyfluorocarbon coating on a razor blade cutting edge comprising the steps of: dispersing a fluorocarbon polymer in a supercritical fluid; coating said razor blade cutting edge with the dispersion; and heating the coating sufficiently to adhere the fluorocarbon polymer to the blade edge.

20 Claims, No Drawings

METHOD OF TREATING RAZOR BLADE CUTTING EDGES

FIELD OF THE INVENTION

This invention relates to an improved method of producing razor blade cutting edges by coating the blade edge with a dispersion of polyfluorocarbon particles suspended in a supercritical fluid and subsequently heating the polyfluorocarbon. The present method provides a homogeneous polyfluorocarbon coating across the blade edge, yet eliminates the need to utilize environmentally hazardous solvents.

BACKGROUND OF THE INVENTION

Uncoated razor blades, despite their sharpness, cannot be employed for shaving a dry beard without excessive discomfort and pain, and it is as a practical matter necessary to employ with them a bear-softening agent such as water and/or a shaving cream or soap. The pain and irritation produced by shaving with uncoated blades are due to the excessive force required to draw the cutting edge of the blade through the unsoftened beard hairs, which force is transmitted to the nerves in the skin adjacent the hair follicles from which the beard hairs extend, and, as is well known, the irritation produced by excessive pulling of these hairs may continue for a considerable period of time after the pulling has ceased. Blade coatings were developed to solve these shortcomings.

Granahan et al., U.S. Pat. No. 2,937,976, issued May 24, 1960, describes a "coated" blade which provides a reduction in the force required to cut beard hair. The coating material consists of an organosilicon-containing polymer which is partially cured to a gel which remains adherent to the blade. Although these coated blades met with considerable commercial success, the coatings were not permanent and would wear off relatively quickly.

Fischbein, U.S. Pat. No. 3,071,856, issued Jan. 8, 1963, describes fluorocarbon-coated blades, particularly polytetrafluoroethylene-coated blades. The blades may be coated by (1) placing the blade edge in close proximity to a supply of the fluorocarbon and subsequently heating the blade, (2) spraying blade with a fluorocarbon dispersion, (3) dipping the blade into a fluorocarbon dispersion or (4) by use of electrophoresis. The resulting blade was later heated to sinter the polytetrafluoroethylene onto the blade edge.

Fischbein, U.S. Pat. No. 3,518,110, issued Jun. 30, 1970, discloses an improved solid fluorocarbon telomer for use in coating safety razor blades. The solid fluorocarbon polymer has a melting point between 310° C. and 332° C. and has a melt flow rate of from 0.005 to 600 grams per ten minutes at 350° C. The molecular weight is estimated to be between 25,000 and 500,000. For best results, the solid fluorocarbon polymer is broken down to 0.1 to 1 micron particles. The dispersion is electrostatically sprayed onto stainless steel blades.

Fish et al, U.S. Pat. No. 3,658,742, issued Apr. 25, 1972, discloses and aqueous polytetrafluoroethylene (PTFE) dispersion containing Triton X-100 wetting agent which is electrostatically sprayed on blade edges. The aqueous dispersion is prepared by exchanging the Freon solvent in Vydax brand PTFE dispersion (PTFE+Freon solvent), distributed by E. I. DuPont, Wilmington, Del., with isopropyl alcohol and then exchanging the isopropyl alcohol with water. Example 1 discloses an aqueous PTFE dispersion containing 0.4% PTFE and 0.1% triton X-100 wetting agent.

Trankiem, U.S. Pat. No. 5,263,256, issued Nov. 23, 1993 (Docket No. 7951 ) discloses on an improved method of forming a polyfluorocarbon coating on a razor blade cutting edge comprising the steps of subjecting a fluorocarbon polymer having a molecular weight of at least about 1,000,000 to ionizing radiation to reduce the average molecular weight to from about 700 to about 700,000; dispersing the irradiated fluorocarbon polymer in an aqueous solution; coating said razor blade cutting edge with the dispersion; and heating the coating obtained to melt, partially melt or sinter the fluorocarbon polymer. Although these coatings adhere well to the blade edge it is very difficult to form acceptable aqueous dispersions without agitation or stirring.

Trankiem, U.S. patent application Ser. No. 08/232,197, filed Apr. 28, 1994 (Docket No. 4210) discloses a method of forming a polyfluorocarbon coating on a razor blade cutting edge comprises subjecting a fluorocarbon polymer having a molecular weight of at least 1,000,000 in dry powder form to ionizing irradiation to reduce the molecular weight of the polymer forming a dispersion of the irradiated polymer in a volatile organic liquid, spraying the dispersion on to a razor blade cutting edge and heating the coating obtained to sinter the polyfluorocarbon. The polyfluorocarbon preferably is polytetrafluoroethylene and irradiation preferably is effected to obtain a telomer having a molecular weight of about 25,000. Although these coatings adhere well to the blade edge it must be agitated to form acceptable dispersions in many volatile organic liquids without agitation and, in general, these solvents are not recommended due to their potentially adverse affect on the environment. (i.e. They are currently listed as hazardous volatile organic compounds (VOC's)).

An object of the present invention is to provide an environmentally- friendly method of coating razor blade edges with polyfluorocarbons, particularly polytetrafluoroethylene. Specifically, it is an object of the present invention to eliminate chlorofluorocarbon solvents and volatile organic solvents from the blade coating process.

It is also an object of the present invention to provide a razor blade cutting edge which produces substantially equal cutting and wear characteristics as chlorofluorocarbon dispersion-coated blades.

Another object of the present invention is to provide an environmentally-friendly method of laying down a homogeneous polyfluorocarbon coating on the cutting edge of razor blades.

And another object is to provide a method of dispersing the polyfluorocarbon particles in a blade-coating feed stream which requires no stirring or additional agitation.

Yet another object of the present invention is to provide an improved dispersion of polyfluorocarbon particles for use in blade-coating operation.

These and other objects will be apparent to one skilled in the art from the following:

SUMMARY OF THE PRESENT INVENTION

The present invention relates to a method of forming a polyfluorocarbon coating on a razor blade cutting edge comprising the steps of: dispersing a fluorocarbon polymer in a supercritical fluid; coating said razor blade cutting edge with the dispersion; and heating the coating sufficiently to adhere the fluorocarbon polymer to the blade edge.

DETAILED DESCRIPTION OF THE PRESENT INVENTION

All percentages and ratios described herein are on a weight basis unless otherwise indicated.

As used herein the term "razor blade cutting edge" includes the cutting point and facets of the blade. Applicant recognizes that the entire blade could be coated in the manner described herein; however; an enveloping coat of the type is not believed to be essential to the present invention.

As used herein, the term "supercritical fluid" means a dense gas that is maintained above its critical temperature (the temperature above which it cannot be liquefied by pressure). Such fluids are less viscous and diffuse more readily than liquids, and are thus have proved to be more efficient than other solvents in certain applications, e.g. liquid chromatography.

Various methods have been proposed in the past for preparing and utilizing environmentally friendly dispersions of fluorocarbon polymer to coat razor blade cutting edges. See, for example, U.S. Pat. No. 5,263,256 to Trankiem, incorporated herein by reference. All of these methods invariably produced a blade which has a less than homogeneous coating of polymer. This can result in inconsistencies in the cutting force across the length of a blade. Surprisingly, applicant has discovered that when fluorocarbon polymer, particularly polytetrafluoroethylene, dispersed in a supercritical fluid is utilized, the blades exhibit a significant improvement in coating homogeneity compared with prior art systems. The blade produced by the present invention exhibit consistently low forces to cut water-softened hair. This consistency in cutter force persists during several successive shaves with the same blade cutting edge.

According to the present invention, a dispersion is prepared from a fluorocarbon polymer. The preferred fluorocarbon polymers (i.e., starting material) are those which contain a chain of carbon atoms including a preponderance of $—CF_2—CF_2—$ groups, such as polymers of tetrafluoroethylene, including copolymers such as those with a minor proportion, e.g. up to 5% by weight of hexafluoropropylene. These polymers have terminal groups at the ends of the carbon chains which may vary in nature, depending, as is well known, upon the method of making the polymer. Among the common terminal groups of such polymers are, —H, —COOH, —Cl, $—CCl_3$, $—CFClCF_2Cl$, $—CH_2OH$, $—CH_3$ and the like. While the precise molecular weights and distribution of molecular weights of the preferred polymers are not known with certainty, it is believed that they have molecular weights of from about 700 to about 700,000 preferably from about 700 to about 51,000 and most preferably about 50,000. The preferred chlorine-containing polymers are those containing from 0.15 to 0.45% by weight of chlorine (which is present in the terminal groups). There may be used mixtures of two or more fluorocarbon polymers, provided the mixtures have melt and melt flow rate characteristics as specified above, even though the individual polymers making up the mixture do not possess these characteristics. The most preferred starting material is polytetrafluoroethylene (PTFE).

The most preferred polyfluorocarbon is produced by fluorocarbon polymer starting material having a molecular weight of at least 1,000,000 in dry powder form, which is subjected to ionizing irradiation to reduce the average molecular weight of the polymer to from about 700 to about 700,000, preferably to from about 700 to about 51,000 and most preferably to about 50,000. This process is described in U.S. Pat. No. 5,263,256 incorporated herein by reference. The radiation dose is preferably from 20 to 80 Mrad and the ionizing radiation is preferably by gamma rays from a $Co^{60}$ source. The polyfluorocarbon is preferably polytetrafluoroethylene and irradiation is preferably effected to obtain a telomer having an average molecular weight of about 25,000.

Supercritical Fluid

Although supercritical fluids exhibit very low solvency toward the polytetrafluoroethylene, I have discovered that the polytetrafluoroethylene can be dispersed in the supercritical fluid and successfully dispensed on to the blade edges.

In the last decade, supercritical fluids have been used in extraction, polymer fractionation, chromatography and catalyst generation. They are also used as a reaction medium (synthesis, including polymerization), for cleaning and for infusion of drugs into a substrate.

Supercritical fluid has properties intermediate between normal liquids and gases. Although any material can be made into supercritical fluid, gas is preferred because if can be compressed at low temperature. Examples of such gases are carbon dioxide, ammonia, nitrous oxide, ethane, ethylene and propane. Liquids require high temperature to be supercritical.

Carbon dioxide has been used extensively, and to a lesser extent ammonia and nitrous oxide. They all have high solubility, and high diffusivity into organic materials at low cost. However, carbon dioxide ($CO_2$) is preferred. Carbon dioxide is environmentally friendly. It is on EPA's permissible emission list. Its TLV is 5000 ppm/$m^3$ (5%, above causes suffocation). See K. A. Nielsen et al., *Supercritical Fluid Spray Application Technology*, Union Carbide Report 1990. Presently, $CO_2$ is made from by products of natural oil wells, fermentation that otherwise would be released to the environment. Plus, $CO_2$ is nonflammable and mostly inert, so it does not interfere with the blade coating. Eating or drinking it is safe, as is evident from its use in beverages.

Carbon dioxide is known to be a good solvent in coating operations where it either dissolves, solubilizes or swells polymers. Also, its solubility parameter can be from 1 to 8 by adjusting temperatures and pressures.

Polymer properties determine carbon dioxide solubility in coating formulation. Favorable characteristics are low molecular weight, low polydispersivity and low solubility parameter among others. Supercritical fluid $CO_2$ solubility has been found to increase in systems that have fluorine, silicone and bulky substituent groups in polymer structure. See Argyropoulos et al. "Polymer Chemistry and Phase Relationships of Supercritical Fluid Sprayed Coatings", Proceedings of the 21st Water-Borne, Higher-Solids, and Powder Coatings, Synosium, New Orleans, (February 1994).

Carbon dioxide has high diffusivity into organic materials because of its low viscosity and possible low surface tensions. For example, the viscosity of 65% polyacrylic acid/2-heptanone is 1000 centipoises. With 28% of supercritical fluid $CO_2$, the viscosity is reduced to 30 centipoises. High diffusivity and solubility indicate that supercritical $CO_2$ is good for extraction, infusion and high-solid coating applications. See Nielsen et al., "Application of High Solids Coatings Using Supercritical Fluids", High Solids Coatings®- 1993 Buyers Guide, pp. 4–6 (1993).

The critical point of carbon dioxide it 88° F. (31° C.) and 1070 psi (72.9 atm). At this point, $CO_2$ has the density of a liquid but in gas phase. The critical value of $CO_2$ represents a mild, obtainable temperature and the proper pressure for standard spray equipment. See K. A. Nielsen et al. *Supercritical Fluid Spray Application Technology: A Pollution Prevention Technology for the Future*, Union Carbide Report (1990).

Supercritical $CO_2$ delivers a better quality coating than the airless spray, presently utilized in many production processes. Airless spray results in heavier particle size at the bottom of the spray with more material in the center than on the top and bottom of the substrate. See B. M. Hybertson, *Use of Supercritical Fluid Solution Expansion Process for Drug Delivery, Particle Synthesis, and Thin Film Deposition*, UMI Dissertation Services (1991).

Conventional blades using airless solvent systems often show evidence of this uneven coating. I have observed that $CO_2$ spray provides a very homogeneous coating of PTFE on blade edges. Without being bound to theory, it is believed that this is partly due to the expansion force of $CO_2$ when it is ejected from a high pressure to a lower pressure. Thus, supercritical $CO_2$ makes better usage of the expansion force vs. the non-supercritical.

Polyfluorocarbon dispersions according to the present invention comprise from 0.05 to 5% (wt) polyfluorocarbon, preferably from 0.7 to 1.2% (wt) disperses by agitation in the supercritical solvent. The polymer can be introduced into the flow stream or mixed directly into an agitated reservoir. When injected into the flow stream, a static mixer downstream is preferred. The preferred polyfluorocarbons include MP1100, MP1200 and MP1600 brand polytetrafluoroethylene powders manufactured by DuPont. The most preferred are MP1100 and MP1600.

cially preferred for coating the cutting edges, in which case, an electrostatic field is preferably employed in conjunction with the nebulizer in order to increase the efficiency of deposition. For further discussion of the electrostatic spraying technique, see U.S. Pat. Nos. 5,211,342 and 5,203,843 to Hoy et al., incorporated in their entirety herein by reference. For a further discussion of supercritical fluid coating and spraying techniques see U.S. Pat. Nos.: 5,203,843 to Hoy et al.; 5,108,799 to Hoy et al.; 5,066,522 to Cole et al; 5,027,742 to Lee et al.; and 4,923,720 to Lee et al.; incorporated herein in their entirety by references. Preheating of the blades to a temperature approaching the boiling point of the supercritical fluid (31° C.) may also be desirable.

According to the present invention, a mixture of supercritical $CO_2$, polyfluorocarbon polymer is sprayed on to a substrate blade to form a liquid coating thereon by passing the liquid mixture under pressure through an orifice into the environment of the substrate to form a liquid/gas spray.

Orifice sizes suitable for the practice of the present invention generally range from 0.004 inch to 0.072 inch diameter. Smaller orifice sizes are preferred, orifices are from 0.004 inches to 0.025 inches in diameter are preferred. Orifice sizes from 0.007 inches to about 0.015 inch diameter are most preferred. Generally the substrate will be sprayed from a distance of about 1 to 12 inches.

Typical Properties of TEFLON Fluoroadditives*

| Product | Method | Units | MP1100 | MP1200 | MP1600 |
|---|---|---|---|---|---|
| Powder Particle Size | | | | | |
| No more than 10% of the particles are smaller than: | 1 | micrometer ($m \times 10^{-4}$) | 0.3 | 1 | |
| Average | 1 | micrometer | 1.8–4 | 2.5–4.5 | 6–12 |
| 90% of the particles are smaller than: | 1 | micrometer | 8 | 7.7 | |
| Primary Particle Size | microscopy | micrometer | 0.2 | — | 0.2 |
| Specific Surface Area | $N_2$Adsorption | $m^3/g$ | 5–10 | 2.3–4.5 | 8–12 |
| Apparent (Bulk) Density | ASTM D1457 | g/L | 200–425 | 375–525 | 250–500 |
| Polymer Specific Gravity (Relative Density) | 1 | — | 2.2–2.3 | 2.2–2.3 | 2.2–2.3 |
| Melting Peak Temperature | ASTM D1457 | *C. (°F.) | 320 ± 10 (608 ± 18) | 320 ± 10 (608 ± 18) | 325 ± 10 (617 ± 18) |
| Temperature Service Range | ASTM D1457 | *C. (°F.) | −190 to 260 (−310 to 500) | −190 to 260 (−310 to 500) | −190 to 260 (−310 to 500) |
| Compliance with U.S. FDA Regulations for Use in Contact with Food[3] | FDA Protocol | — | No | No | Yes |

*Typical Properties provided in DuPont Sales Literature (1995).
*By Leeds and Northrup Microtrac ® If particle analyzer, dispersion time 12 minutes.
*Value not measured. Calculated assuming a void-free molding at 100% crystallinity.
*Important: Before adoption, see DuPont Bulletin H-22779 for referral to specific U.S. Federal Food and Drug Administration amendments permitting use of TELFLON fluoroadditives as articles or components of articles intended for use in contact with food. Some limitations and conditions of use apply The preferred supercritical fluid is carbon dioxide.

For the purpose of forming the dispersion which is sprayed onto the cutting edges, the polyfluorocarbon should have a fine particle size, preferably and average particle size of not more than about 100 microns. In a preferred embodiment, the average particle size range is from about 0.2 microns to about 12 microns. Powdered polyfluorocarbon starting material is normally available as a coarser material than this and it may be ground to this fineness either before of after the irradiation step, preferably the latter. Typically, the level of the polyfluorocarbon, in the dispersion is from about 0.05% to about 5% (wt), preferably from 0.7% to about 1.2% (wt).

The dispersion may be applied to the cutting edge in any suitable manner to give as uniform a coating as possible, as for example, by dipping or spraying; nebulization is espe- The preferred sprayed pressure is between 1200 psi and 2500 psi. The most preferred spray pressure is between 1070 psi and 300 psi. The minimum spray temperature is about 31° centigrade. The preferred sprayed temperature is between 35° and 90° centigrade. The most preferred temperature is between 45° and 75° centigrade.

During the spraying operation, the spray undergoes rapid cooling while it is close to the orifice, so the temperature drops rapidly to near or below ambient temperature. If the spray cools below ambient temperature, entrapment of ambient air into the spray warms the spray to ambient or near ambient temperature before the spray reaches the substrate. This rapid cooling is beneficial, because less active solvent evaporates in the spray in comparison to the amount of solvent lost in conventional heated airless sprays. Thus, preheating of the dispersion may be desirable to facilitate spraying, the extent of preheating depending on the nature of the dispersion.

Finally, heating of the coating on the blade edge is intended to cause the polymer to adhere to the blade. The heating operation can result in a sintered, partially melted or melted coating. A partially melted or totally melted coating is preferred as it allows the coating to spread and cover the blade more thoroughly. For more detailed discussions of melt, partial melt and sinter, see *McGraw-Hill Encyclopedia of Science and Technology*, Vol. 12, 5th edition, pg. 437 (1992).

In any event the blades carrying the deposited polymer particles on their cutting edges must be heated at an elevated temperature to form an adherent coating on the cutting edge. The period of time during which the heating is continued may vary widely, from as little as several seconds to as long as several hours, depending upon the identity of the particular polymer used, the nature of the cutting edge, the rapidity with which the blade is brought up to the desired temperature, the temperature achieved, and the nature of the atmosphere in which the blade is heated. While the blades may be heated in an atmosphere of air, it is preferred that they be heated in an atmosphere of inert gas such as helium, nitrogen, etc., or in an atmosphere or reducing gas such as hydrogen, or in mixtures of such gases, or in vacuo. The heating must be sufficient to permit the individual particles of polymer to, at least sinter. Preferably, the heating must be sufficient to permit the polymer to spread into a substantially continuous film of the proper thickness and to cause it to become firmly adherent to the blade edge material.

The heating conditions, i.e. maximum temperature, length of time, etc., obviously must be adjusted so as to avoid substantial decomposition of the polymer and/or excessive tempering of the metal of the cutting edge. Preferably the temperature should not exceed 430° C.

The following specific examples illustrate the nature of the present invention. The quality of the first shave obtained with blades of each of the following examples is equal to the quality obtained with the fluorocarbon-polymer-coated blades manufactured with a chlorofluorocarbon solvent presently available. Furthermore, the homogeneity of the present coatings is superior to fluorocarbon polymer-coated blades manufactured with an aqueous or VOC solvent previously known

EXAMPLE

Polyfluorocarbon Dispersion

A 1% PTFE dispersion in supercritical $CO_2$ is prepared. The polyfluorocarbon is MP-1100 brand Teflon® fluoroadditive manufactured and distributed by E. I. DuPont. The average particle size is 1.8–4 microns. The carbon dioxide is maintained at a temperature of about 88° F. (31 ° C.) and a pressure of at least about 1070 psi (72.9 ATM). The dispersion is maintained by agitating the dispersion reservoir.

Blade Edge Coating

The dispersion is ejected on to the blade edge through and atomizer having a diameter of about 0.010 inches. The distance from the orifice to the blade edge is about 12 inches.

Blades

A standard stainless steel Track II razor blade is positioned 12 inches in front of the orifice. Coating is sprayed on to the edges. After spraying, the blades are heated to a temperature of about 350° C. to sinter the fluorocarbon polymer on to the blade edges. Final Teflon coating thickness on the blade edge is about 3000 Å.

What is claimed is:

1. A method of forming a polytetrafluoroethylene coating on a razor blade cutting edge comprising the steps of:

(a) dispersing a polytetrafluoroethylene in a supercritical fluid;

(b) coating said razor blade cutting edge with the dispersion; and (c) heating the coating sufficiently to adhere the polytetrafluoroethylene to the blade edge.

2. A method according to claim 1 where said coating is produced by spraying the dispersion through an orifice having a diameter of from about 0.004 to 0.072 inches.

3. A method according to claim 2 where said coating is produced by spraying the dispersion through said orifice having a diameter of from about 0.004 to 0.025 inches.

4. A method according to claim 3 where said coating is produced by spraying the dispersion through said orifice having a diameter of from about 0.007 to 0.015 inches.

5. A method according to claim 3 where said coating is produced by spraying the dispersion at a pressure of from 250 to 1200 psi.

6. A method to claim 5 where said pressure is from 300 to 1070 psi.

7. A method according to claim 5 where said dispersion is maintained at a temperature of from 35° to 90° C. prior to spraying.

8. A method according to claim 7 where said temperature is from 45° to 75° C.

9. A method according to claim 8 where said polytetrafluoroethylene is in the form of finely divided particles less than 100 microns in diameter.

10. A method according to claim 9 where said polytetrafluoroethylene is in the form of finely divided particles having an average particle size of from about 0.2 to about 12 microns.

11. A method according to claim 9 where said dispersion contains from about 0.05% (wt) to about 12% (wt) polytetrafluoroethylene.

12. A method according to claim 11 where said dispersion contains from about 0.7% (wt) to about 8% (wt) polytetrafluoroethylene.

13. A method according to claim 11 where the polytetrafluoroethylene has an average molecular weight of from about 700 to about 700,000 g/mol.

14. A method according to claim 13 where the polytetrafluoroethylene has an average molecular weight of from about 700 to about 51,000 g/mol.

15. A method according to claim 11 where the polytetrafluoroethylene is produced from a fluorocarbon polymer starting material having a molecular weight of at least 1,000,000 in dry powder form, which is subjected to ionizing irradiation to reduce the average molecular weight of the polymer to from about 700 to about 700,000.

16. A method according to claim 15 where the polytetrafluoroethylene is produced from a fluorocarbon polymer starting material having a molecular weight of at least 1,000,000 in dry powder form, which is subjected to ionizing irradiation to reduce the average molecular weight of the polymer to from about 700 to about 51,000.

17. A method according to claim 14 where the heating of step (c) is sufficient to melt, partially melt or sinter the polymer.

18. A method according to claim 17, where the heating of step (c) is sufficient to sinter the polymer.

19. A method according to claim 16 where the heating of step (c) is sufficient to melt, partially melt or sinter the polymer.

20. A method according to claim 19, where the heating of step (c) is sufficient to sinter the polymer.

* * * * *